United States Patent [19]

Strohmeyer, Jr.

[11] 4,442,796

[45] Apr. 17, 1984

[54] MIGRATING FLUIDIZED BED COMBUSTION SYSTEM FOR A STEAM GENERATOR

[75] Inventor: Charles Strohmeyer, Jr., Gladwyne, Pa.

[73] Assignee: Electrodyne Research Corporation, Gladwyne, Pa.

[21] Appl. No.: 456,586

[22] Filed: Jan. 7, 1983

Related U.S. Application Data

[63] Continuation-in-part of Ser. No. 448,028, Dec. 8, 1982.

[51] Int. Cl.[3] ..... F22B 1/00

[52] U.S. Cl. ..... 122/4 D; 110/245; 110/263; 431/170; 431/173

[58] Field of Search ..... 122/4 D; 431/7, 170, 431/173; 110/245, 263; 165/104.16

[56] References Cited

U.S. PATENT DOCUMENTS

| | | | |
|---|---|---|---|
| 4,294,178 | 10/1981 | Borio et al. | 431/173 |
| 4,308,806 | 1/1982 | Uemura et al. | 110/245 |
| 4,372,228 | 2/1983 | Korenberg | 110/245 |

FOREIGN PATENT DOCUMENTS

| | | | |
|---|---|---|---|
| 54-149277 | 11/1979 | Japan | 431/170 |
| 55-68506 | 5/1980 | Japan | 431/170 |

*Primary Examiner*—Edward G. Favors
*Assistant Examiner*—Steven E. Warner
*Attorney, Agent, or Firm*—William J. Ruano

[57] ABSTRACT

The invention comprises a steam generator having a migrating fluidized bed combustor system. The bottom, head end of the bed incorporates a support floor system through which air is admitted tangential to the floor in a manner which causes the bed to migrate in a retraceable track. Tangential admission of air cools the floor and inhibits reverse flow down through the floor when the bed is slumped. Particle entrainment velocities are developed at mid-point in the bed. Tangential entrainment gas flow assures uniform distribution of combustibles and inert material throughout the lower bubbling bed and furnace area above the mid-point. Platens in the furnace zone straighten gas flow for gravity separation of particulate at the outlet of heat transfer surface above the furnace.

5 Claims, 3 Drawing Figures

MIGRATING FLUIDIZED BED COMBUSTION SYSTEM FOR A STEAM GENERATOR

This invention is a continuation-in-part of U.S. Pat. Application Ser. No. 448,028 filed Dec. 8, 1982.

This invention relates to means for improving the performance of steam generators having fluidized bed combustors.

Past fluidized bed combusters have had problems with the bottom support structure of the bed, fuel feed and ash removal systems in a way which upset temperatures throughout the bed. Hot spots resulting in slag formations followed by cooling action have resulted in clinker formations difficult to remove and which obstruct air admission to the bed. These problems result in configurations which are not well suited for the construction of large sized steam generators having fluidized bed combustors.

The present invention overcomes past difficulties in that the migrating bed design assures thorough mixing of air, fuel and inert material throughout the bed. The air entering through the bed floor is directional and is tangential to the bed floor. This causes the bed to migrate in the direction toward which air admission is pointed. The relationship of fuel and inert material to air admission ports is ever changing which results in an averaging effect. Such movement simulates a stirring action within the bed. The cooler air passing over the floor shields the floor from the hot combustion process directly above. The air discharge configuration from the floor inhibits reverse flow of bed materials down through the floor.

Secondary air/gas tangentail admission to the bed induces bed mixing carrying particulate from the perimeter to the center of the bed. Particulate is carried up into the furnace with air/gas stream. The cyclonic action of the gas, inert material and active fuel enables high heat release to be achieved at low, uniform combustion temperature which is essential when constructing large steam generators of the fluidized bed type.

The high agitation from admission of the secondary air/gas is distributed among the compartmentalized zones of the furnace. The platen construction in parallel with the furnace waterwalls in the furnace zone of the circulating portion of the fluidized bed increases heat transfer capabilities without increase of furnace height. Uniform gas and bed temperatures can be maintained in an environment which minimizes tube erosion.

The platens straighten air flow from the cyclonic discharge of the combustors below and assists in the gravity separation of particulate as described below.

For the steam generator described herein a specific object of this invention is to provide a floor for a fluidized bed combustor which admits air directionally to the bed causing the bed to migrate through a retraceable path in the fixed or bubbling portion of the bed.

A further object is to admit air to the bed to cool the floor of the combustor.

A still further object is to admit air to the bed in a manner which inhibits back flow of particulate through the floor when the bed is slumped.

A still further object is to provide extended surface in the furnace portion of the circulating bed to limit size of furnace required, assure uniform temperature throughout the furnace and facilitate large unit construction.

A still further object is to straighten the cyclonic gas flow pattern rising out of the combustor to facilitate gravity separation of particulate at the outlet of the heat exchange surface above the furnace.

The invention will be described in detail with reference to the accompanying drawings wherein.

Figure 1:
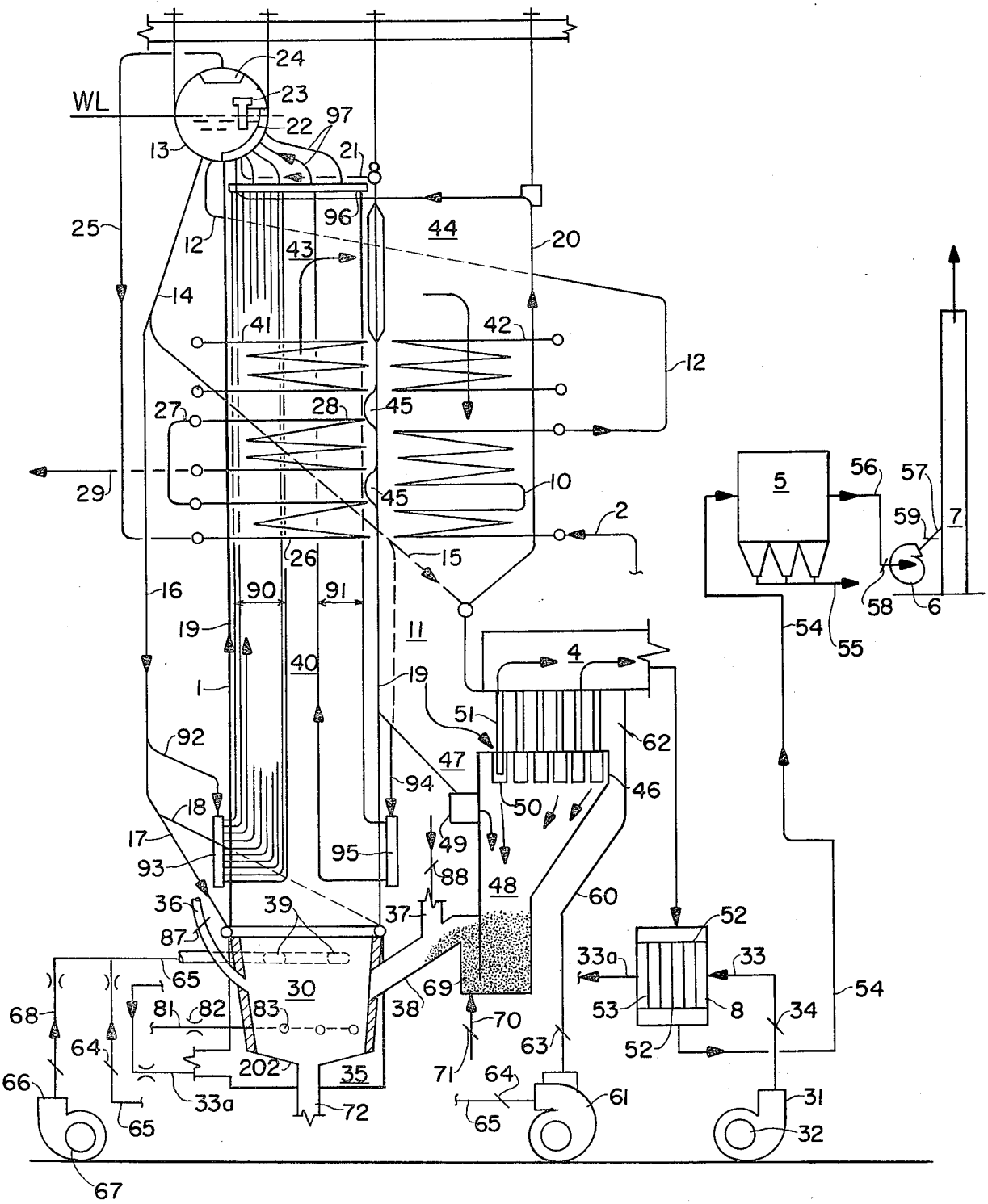
FIG. 1 is a schematic diagram of a steam generator having a fixed and circulating type fluidized bed combined in accordance with the objectives of this invention.

FIG. 1 is a side elevation of an application covered by this invention. Steam generator 1 is of a conventional design with regard to the fluid circuits. Feedwater at the working pressure enters the unit through conduit 2.

Conduit 2 feeds to economizer 10 which lowers exit gas temperature in duct 11 to a range of 650 F.

Effluent from economizer 10 passes through conduit 12 to drum 13 from whence it passes through conduits 14, 15, 16, 17 and 18 to lower waterwall header which supply the furnace and convection pass waterwalls 19 and 20 respectively. The waterwalls, including side walls, are of the membrane type. Waterwalls 19 and 20 discharge to drum 13. The rear furnace wall 19 is connected to drum 13 through conduit 21.

Baffle 22 within drum 13 directs the steam and water mixture to separators 23. Separated water exits from the bottom of separators 23 and joins with feedwater from conduit 12 and is recirculated downward through conduit 14. Separated steam passes through the top of separators 23 through baffles and up through outlet screens 24 to conduit 25.

Conduit 25 connects to primary superheater 26 and through conduit 27 to secondary superheater 28 from whence it flows out through conduit 29 to a steam consumer (not shown).

Water level WL in drum 13 is maintained at a fixed set point by control of feedwater flow through conduit 2 (not shown).

Combustor 30 is of a modified cyclonic type wherein particulate migrates around the bed.

F.D. fan 31 takes air from atmosphere through inlet vanes 32 which control air flow. F.D. fan 31 discharges through duct 33 and shutoff damper 34 (for isolation purposes) to air heater 8. The hot air then passes through duct **33*a* to plenum chamber 35**.

Plenum chamber 35 feeds air to combustor 30 through sized holes 144 in the floor 202 of combustor 30. Details of floor 202 construction are described below. The flow through floor 202 is directed into combustor 30 in a manner to create a swirling flow around floor 202 of combustor 30.

Primary fuels, as coal, are fed to combustor 30 through conduit 36. Where $SO_2$ removal is required, limestone is injected with the fuel through conduit 36. Flow control means 87 regulates rate of flow through conduit 36. Fuels as coal along with limestone are stored upstream of flow control means 87 and mixing of the two is not part of this invention. When firing oil in combustor 30, limestone may be fed individually through conduit 36. Secondary fuels as trash and waste products enter combustor 30 through conduit 37 and conduit 38. Flow control means 88 is located in conduit 37. Alternatively, conduit 36 could be integrated with conduits 37 and 38.

Ignition begins in the lower portion of combustor 30 and as the swirling particles rise in the fluidized bed through displacement from fuel and limestone feed and particulate recirculation, they reach the level at which ports 39 are located. Ports 39 supply secondary gas flow which generates sufficiently high gas velocities at this point to entrain desired quantities of bed solids in the gas flow, carrying such solids upward into furnace 40.

The density of the bed solids in furnace 40 decreases as penetration into the downstream gas path increases. The particulate velocities also increase with penetration due to diminuation in size. There is a velocity increase after the gas enters surface 26, 28, 41, 42 and 10 in series. A gas velocity decrease occurs at the exit of the tube banks.

Surface 41 and 42 can be reheating surface or an extension of or an alternative for superheating or economizer surface.

Reaction or fuel burnup extends upward into the initial tube banks 26, 28 and 41 as required for heat transfer balance. It is the intent to cool the gas in sections 42 and 10 or earlier in 41 and 28 from a level of 1550 F. in furnace 40 to a level of 650 F. in gas duct 11 at economizer 10 outlet.

Spacings of platens 26, 28 and 41 take into account volumetric decreases as gas temperatures decrease so as to sustain desired particulate entrainment gas velocity to the outlet of surface 41 at the top of the vertical column.

The volumetric relationship of plenums 43 and 44 is such to permit the gas velocity to drop below entrainment level at the outlet of platens 41 to permit settlement of particulate which, when fluidized, will overflow and fall downward along the rear of rear furnace wall 19 to the plenum in gas duct 11. There is sufficient space between platens 42 and 10 and rear wall 19 to permit passage of separated particulate.

Gas passes from plenum 43 to plenum 44 through rear furnace wall tubes 19 at which point the membrane is lacking and alternating tubes have been spread sufficiently to permit free passage of gas. The slight obstruction creates uniform flow across the vertical tubular cross section which assists in particulate separation from the gas stream.

In cases where particulate separation from the gas stream can be expected above tube banks 26 and 28, bypass ports 45 can be built into rear furnace wall 9 to permit spillover of particulate into the down flow section from plenum 44 to duct 11. Such flow would follow the rear furnace wall 19 to plenum 11.

Particulate collected from the rear furnace wall 19 in plenum 11 falls to hopper 47 adjacent to hopper 48 at the outlet of multiclone dust collector 46. Rotary feederr 49 is power driven and feeds dust from hopper 47 to hopper 48 and is provided with a displacement type seal which prevents gas from bypassing the multiclones.

Each multiclone is provided with an inlet tube 50. A gas exhaust tube 51 extends part way into inlet tube 50. Vanes (not shown) are installed between tubes 50 and 51 to spin the gas and dust as it flows downward through tube 50. The particulate follows the wall of tube 50 and discharges to hopper 48. The clean gas turns upward and flows through tube 51 to plenum 4 from whence it passes through ducting to air heater 8.

Air heater 8 is provided with tube sheets 52 in which tubes 53 are mounted. The gas from duct 4 passes through tubes 53 to duct 54. F.D. fan 31 discharge air flow passes around tubes 53. Gas duct 54 passes to bag house 5 where dust collection is completed. Dust separated in the bags is removed through conduits 55.

Bag house 5 discharges through duct 56 to I.D. fan 6 and duct 57 to stack 7 and from thence to atmosphere. Dampers 58 and 59 are for isolation purposes and to regulate flow of gas so as to maintain a slightly negative pressure in furnace 40.

Gas from plenum 4 is drawn through conduit 60 to gas recirculation fan 61. Dampers 62 and 64 are for isolation purposes. Damper 63 is for flow control. Gas recirculation fan 61 discharges through duct 65 to secondary gas ports 39 for developing particulate entrainment gas velocities in furnace 40.

Secondary air fan 66 takes air from atmosphere through inlet vanes 67 and discharges through duct 68 to duct 65 supplementing gas recirculation flow when additional air flow is required for combustion purposes. This permits air to be fed both under and over the point of fuel injection into combustor 30. In such manner ignition characteristics in combustor 30 can be controlled.

Particulate collected in hopper 48 passes through loop seal 69. Dust flow through loop seal 69 is facilitated by means of an air lift. Air under pressure enters through conduit 70 and flow is controlled by regulation means 71 which is power operated.

The recirculation loop of the circulating fluidized bed combustion system can be described as follows: The start of the loop is combustor 30, the point of highest pressure. The combustor 30 is not subject to entrainment gas velocities below ports 39. The lower bed overflows above the secondary gas ports 39 by addition of fuel and limestone through conduit 36 as well as by addition of collected particulates through conduit 38.

Gas flow through secondary gas ports 39 lifts the bed materials up into furnace 40 as a result of gas entrainment velocities. Particulates overflow from the vertical up column to the downflow column connecting to plenum 11, through multiclone separator 46 or rotary feeder 49 to hopper 48, through loop seal and air lift 69 to conduit 38 and back to combuster 30 for recycle.

The ratio of fuel to inert material within the bed should be about the same for both fixed and circulating type fluidized beds.

Ash is normally removed from the circulating loop through the opening at the bottom of combustor 30 and through conduit 72 which is water cooled (not shown). Ash is removed on a continuous basis to maintain equilibrium in the combustion system.

Oil or gas fuel can be admitted through conduit 81, flow control means 82 and nozzles 83 into combustor 30 for firing during unit startup or for use as a supplemental or emergency fuel during times when the design fuel supply has been inerrupted. Nozzles 83 are equipped with ignition means.

The basic fundamental associated with fluidized bed combustion is that fuel is fired in close association with inert particulate so that the radiant aspects of combustion are suppressed. Combustion takes place at a lower temperature and when controlled by means of air flow and the presence of inert material in a range of 1550 F., reaction with limestone for $SO_2$ removal is maximized. Combustion rate can be controlled by both fuel flow and availability of oxygen. The latter is over-riding and limiting.

The above description covers the basic steam generator of the invention to which this invention is a continuation-in-part. This invention relates primarily to the construction of the combustor floor for a fluidized bed firing system which produces migration of the bed over the floor and the effect such migration has upon the operation of the combustor. Furnace heat transfer surface for larger sized fluidized bed combustors is also considered and how such surface must be disposed to facilitate gravity collection of recirculated particulate where the bed is of the recirculating type.

FIG. 2 is illustrative of combustor 30 floor 202 but is not dimentionally accurate. Floor 202 is comprised of support plate 200. The shape indicated on FIG. 2*a* is cylindrical. Other shapes could be employed. The criteria is that the flow over plate 200 follows a retraceable pattern. A square, rectangular or oval pattern would employ a technique having equivalent characteristics to the following description.

Figure 2A:
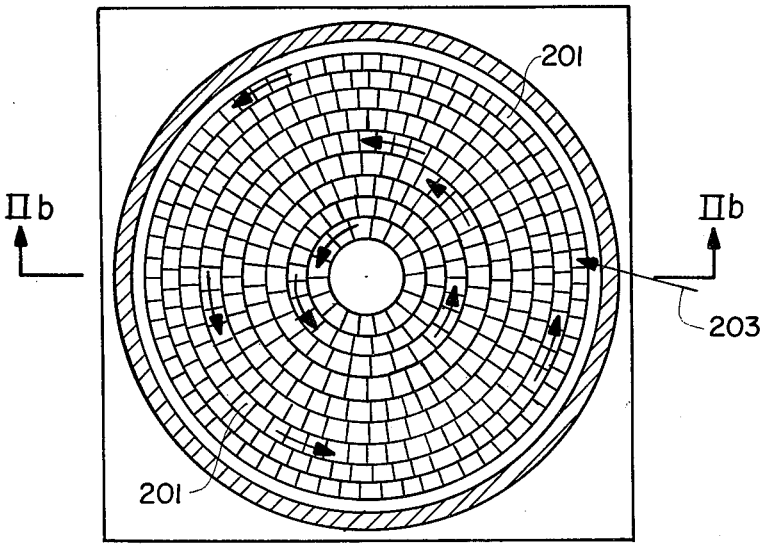
FIG. 2 is a detail of the combustor floor construction.
Figure 2B:
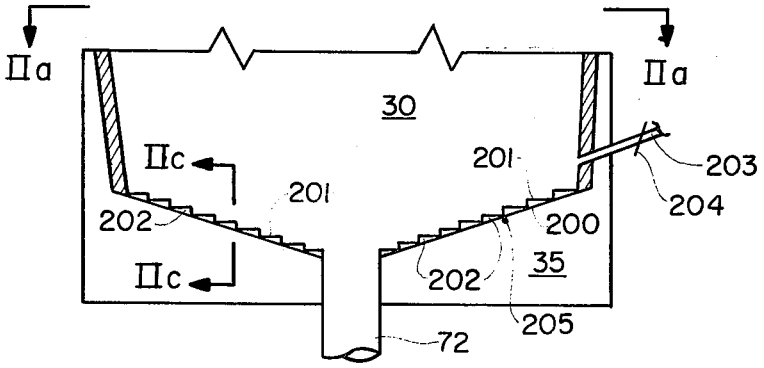
Figure 2C:
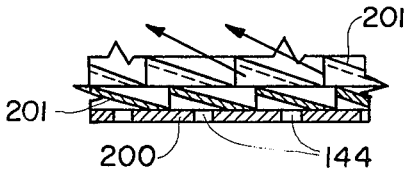

In FIG. 2*c* sized holes 144 are drilled in support plate 200 in a multiple concentric ring arrangement. The center to center dimension between holes 144 is about 3 inches. This dimension is representative only. The holes 144 are sized to pass sufficient air to all protions of floor 202 to sustain uniform operating temperature throughout the bed.

Covers 201 are segmented to form a circular pattern when laid side by side as shown on FIG. 2*a*. Covers 201 are centered over holes 144 and are about 3"×3". Support plate 200 and cover plates 201 are made of steel suitable to resist high temperatures.

Figure 2D:
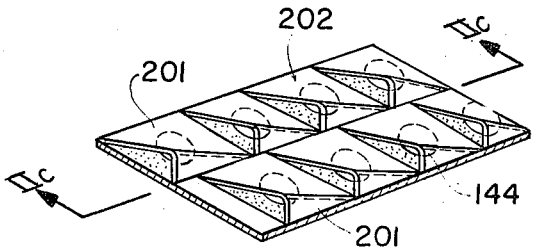

Covers 201 are formed so that when placed over holes 144, three sides of covers 201 are flush with support plate 200 and the fourth side provides a slotted opening between support plate 200 and cover plate 201 as indicated by the dotted areas on FIG. 2*d* and the directional arrows on FIG. 2*c*. The number of sides to covers 201 is immaterial to this invention.

The slotted directional openings directing air from chamber 35 of FIG. 2*b* passing through holes 144 over downstream cover 201 in a tangential relationship to the bed above floor 202 causing migration of the bed is the essence of the invention.

Covers 201 are attached to support plate 200 through weldments or other means on the flush sides assuring a rugged stable structure.

The portion of the fluidized bed directly above floor 202 is of the fixed or bubbling type. Entrainment velocities are not encountered below the secondary air/gas port level.

Air exiting through the slotted openings discharges tangentially to the concentric ring of covers 201 for any particular cover 201. The direction of air flow is indicated by the directional arrows on FIG. 2*a*. Air discharging from one specific cover 201 passes over the downstream cover 201 cooling it. Air from the upstream cover 201 passes over the one specific cover 201 cooling it. Thus, a blanket of cooling air passes over covers 201 throughout the bed. Air passing through holes 144 cools both support plate 200 and the underside of cover 201 directly above each hole 144. Air flowing through chamber 35 to holes 144 cools the underside of support plate 200.

The top covers 201 do not differ any obstruction in the direction of air flow. Heavy particles, small pieces of tramp iron or coal pyrities which enter the furnace and fall to floor 202 are swept by the directional air flow toward outlet conduit 72 where such material can be removed with the ash. The tramp material does not become fluidized and drags on covers 201. The portion of the material closest to the center of the floor 202 and outlet conduit 72 drags due to the inclined inboard edge of cover 201. The flat end of cover 201 at the outer edge permits tramp material to be spun to the adjacent inboard concentric ring and ultimately to conduit 72. This action is facilitated by the FIG. 2*b* configuration in that floor 202 is formed slightly conical. The tramp material is collected flowing downhill.

Covers 201 inhibit reverse flow of ash above floor 202 through holes 144 to plenum 35 at times when the bed is slumped when air flows through holes 144 ceases.

Problems with fluidized bed combustors center about air and fuel admission to the bed along with their diffusion throughout the mass of inert material which is considerable compared with active fuel quantity in the bed at any one time (50:1 ratio). Bed temperature is a function of cooling the combustion process by means of air flow or heat transfer to the fluid circuits. The inert material in the bed acts as a flywheel and holds the bed temperature at levels substantially below that associated with direct combustion of fuel in air.

Uniform temperature throughout a fluidized bed depends upon uniform heat input to all portions of the bed and uniform heat extraction from the bed. Where fluid circuits are submersed within the bed, such circuits tend to create lanes or compartments within the bed which inhibit the flow of the bubbling mixture. Uniformity of fuel feed distribution is exceedingly important in such case.

To fluidize the bed, air must be admitted uniformingly throughout the horizontal cross section of the bed. This has usually been in a random or up direction to avoid complication with the compartmentalization effect of the in bed tube circuits in that such in-bed circuits inhibit cross flow through the circuits. Distribution and mixing of the fuel is localized. Feed of fuel through the bottom of the bed is very effective in the case of fines. Such type of feed system for many points is costly and not without problems. Distribution of fuel over the bed does not assure immersion of fine particles within the bed for burnup. In such case overbed ignition and burnup occurs. Temperature control of combustion over the bed is lost and $SO_2$ recovery in the presence of limestone is deteriorated. Hot spots within the bed which exceed slagging temperatures subject to subsequent cooling create clinkers and problems at the bottom of the bed and particularly with the air distribution system.

The principles of this invention relating to the migrating aspects of the fluidized bed overcome most past problems. The combustor floor 200 construction assures uniform distribution of air throughout the bed in a geometric pattern. The bed floats on a directionally controlled supply of air in a pattern which is retraceable. In the case illustrated, the pattern is a circle.

There are no in bed fluid circuits in the zone where fuel and air mix. Fuel can be admitted at specific points to the rotating bed at the periphery of the bed. As the bed of fuel and inert material circulates it receives air from a continuous string of air admission points. Wide range distribution and mixing of air and fuel supply is achieved.

Circulating ash and fuel which accumulates at the periphery of the bed builds up and flows toward the center of the bed. The secondary air which enters the periphery of the rotating bed above the point of fuel admission, blasts the upper bed surface across the bed and up into the furnace. This drives the peripheral bed material toward the center of the bed enhancing mixing of fuel and air feed. Height of the fixed portion of the bed is leveled through the skimming action of secondary air/gas admission. Temperatures throughout the fixed portion of combustor bed 30 are held constant by thorough mixing of fuel, air and inert material. Temperature in the fixed portion of the bed is related to air flow through the floor 202 of combustor 30. Temperature of the circulating portion of the bed in furnace 40 is related to the air/gas mix from the secondary gas ports. Temperatures in both zones can be biased and held stable during both transient and steady state conditions.

The combustor 30 diameter in the past has been dimensionally limited where cyclones have been used for particulate recovery in circulating fluidized bed systems. To increase steam generator size, a multiplicity of cyclones must be employed. Also, it is necessary to be able to construct and successfully operate combustors having large diameters. Since heat transfer with the fluid circuits occurs above combustor 30 fixed bed in the circulating bed zone of furnace 40, sufficient heat transfer surface for steam generation must be available directly above the bed.

Platens 90 and 91 are shown on FIG. 1 can best accomplish the above objective. Platens 90 and 91 are parallel to the gas stream and gas does not pass through the platens. The platens are disposed so that they have negligible effect on gas differential pressure throughout the gas path and particularly as gas passes from plenum 43 to plenum 44 through the rear furnace wall tube circuits 19. Heat is extracted from the fluidized bed on both sides of platens 90 and 91 by the fluid circulating within the platen tube circuits.

Boiler water from drum 13 passes down through conduits 14, 16 and 92 to header 93 where it is distributed to the individual tube circuits in platen 90. Boiler water from drum 13 passes down through conduits 14, 15 and 94 to header 95 where it is distributed to the individual tube circuits in platen 91. The individual tube circuits of platens 90 and 91 discharge to header 96 and flow through conduits 97 to drum 13 for steam and water separation in separator 23.

The space between platens 90 and 91 permits gas pressure and flow to be equalized on both sides of said platens. Platens 90 and 91 could be combined in a single unit.

FIG. 3 illustrates various large diameter combustor arrangements in combination with furnace enclosure waterwalls and extended surface.

For large sized steam generators, combustors approaching 20 foot in diameter are desired. Four and six of such combustors could support about 270 and 400 MW of steam electric generation respectively.

For the same height, the waterwall area would double for a 20 foot diameter combustor configuration compared with a 10 foot diameter configuration. The surface area or heat release capability is increased four times. If platens 90 and 91 or equivalent were not utilized the furnace height would have to be increased substantially.

Figure 3A:
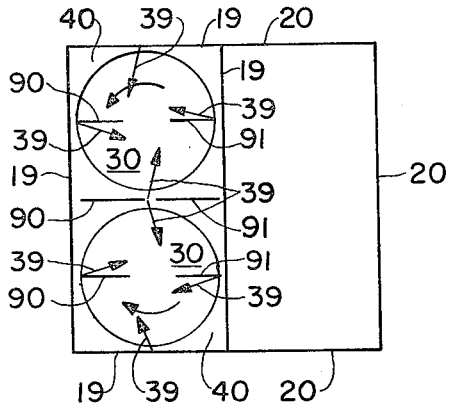
FIG. 3 is a plan as to how extended steam generating surface may be disposed in the furnace in arrangement with secondary air/gas ports for equalizing particulate and gas distribution throughout the compartmentalized portion of the furnace.

FIG. 3*a* is a two combustor configuration having extended surface in furnace 40 over combustor 30. Waterwalls 19 contain furnace 40. The combustor diameter is in a range of 13 to 20 feet or larger. The migrating bed rotates on floor 202 wherein air flow to the bed is admitted in a tangential direction in the direction of the bed rotational arrows. The cyclonic movement of the bed is accentuated by the admission of high velocity secondary air/gas through ports 39. Secondary air/gas is directed into the bed tangentially to the center of the bed through ports 39 in the direction of rotation as indicated in FIG. 3*a*. This lifts the upper portion of the bed up into furnace 40 (see FIG. 1).

The bed in combustor 30 is being continuously replenished with new circulating material from conduits 36 and 38 which are below the level of ports 39. Platens 90 and 91 are located in furnace 40 over combustors 30 as is shown on FIG. 1. The platens 90 and 91 between the two combustors may be fed from below as an alternative to feed through the front and/or rear walls 19.

Open spacing betwen platens 90 and 91 directly over combustors 30 permits equalization of gas and particulate distribution in the furnace 40 zone. Gas velocity in furnace 40 is sufficient to entrain particulate along with the gas stream.

The locations and directions of the secondary air/gas admission ports 39 are designed to uniformly distribute air/gas and particualte flow throughout furnace 40 above each combustor.

The cyclonic action of each combustor 30 simulates tangential firing in a conventional boiler. As the swirling mass is blasted up into furnace 40 by secondary air/gas from from ports 39, the turbulant action of the circulating bed is distributed into local zones created by platens 90 and 91. The available watercooled wall area for contact with the circulating hot bed is increased substantially reducing total furnace volume required for steam generation. Uniform heat abosorption throughout the circulating bed is facilitated which results in more uniform circulating bed temperatures. Regulation of air/gas flows through ports 39 by damper means (not shown) permits regulation and balancing of particulate to all portions of furnace 40. Heat transfer capability is increased by creation of local zones which in turn stabilize gas and particulate flow passing to surfaces 26, 28 and 41 in series. The uniform cooling of gas temperatures throughout the said tube banks facilitates collection from secondary, tertiary, etc. bed formations at the outlet of such tube banks through ports 45 and from plenum 43 to plenum 44 and down along the rear of rear furnace wall 19 to plenum 11.

The location of platens 90 and 91 could be limited to the furnace 40 zone below tube banks 26, 28, 41 or other suitable point.

Figure 3B:
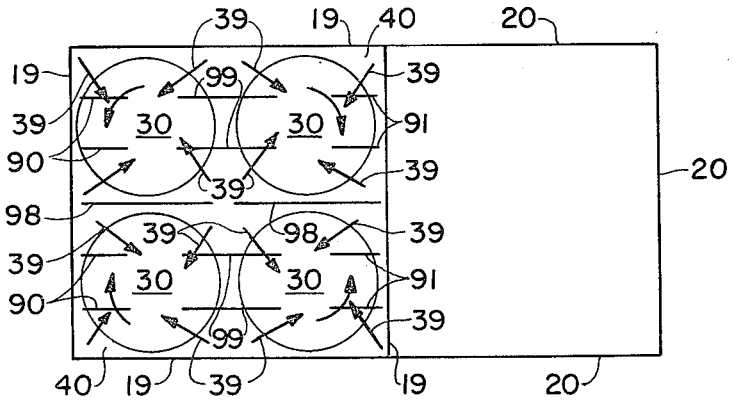

FIG. 3*b* is similar in construction to FIG. 3*a* and the same general description applies. Platens 99 are equivalent to platens 90 and 91 except that they would be supplied with water from the boiler drum from the bottom of furnace 40. Supply tubes would pass through the water cooled floor around combustors 30. Platens 98 would be supplied with boiler water in a similar manner to platens 99.

On FIG. 2*b* a means is provided for cleaning floor 202 when obstructions settle blocking the slotted openings between support plate 200 and cover plate 201. High pressure steam or air at say 125 psig is injected through conduit 203 across covers 201 transversely to the direction of migrating bed travel. Flow control means 204 regulates flow through conduit 203 as required.

Conduits 203 can be located around the periphery of combustor 30. A representative spacing could be an angular spread of 60 degrees. Direction of steam or air injection from conduit 203 is shown on FIG. 2*a*.

Flow control means 204 can be responsive to high temperatures as measured by thermocouples 205 located under floor support plate 200 around the bed. Blowers 203 would be activated individually or in groups and sequentially as required to keep the bed bottom clear of debris.

Thus, it will be seen that I have provided an efficient embodiment of my invention, whereby a means is provided to control horizontal movement of the fixed portion of the bed in a repeatable pattern. The firing surface of the bed floor is cooled by air circulating over the surface and reverse flow of particulate through the floor is inhibited. Secondary air/gas flow admitted tangentially transports material from the bed periphery to the center of the bed for mixing and entrains particulate as it flows up into the circulating portion of the bed. Platens provide extended tubular heat exchange surface increasing heat transfer in the circulating portion of the bed at uniform bed temperatures and in a manner which minimizes tube erosion especially for large steam generators. Gas flow is straightened for particulate separation by gravity means.

While I have illustrated and described several embodiments of my invention, these are by way of illustration only and various changes and modifications may be made within the contemplation of my invention and within the scope of the following claims:

I claim:

1. A steam generator having a feedwater inlet and steam outlet and coolant filled heat absorption circuits disposed in between, a vertical up flow furnace, walls for said furnace including a first portion of said heat absorption circuits, a combustion system contained by said furnace comprising a first ignition and reaction zone at the bottom of said furnace, means for continuously feeding solid fuel and air to said first zone sustaining combustion and generating hot flue gas, a second zone above said bottom of said furnace including means for admission of secondary gas to said furnace, said means for continuously feeding solid fuel concentrating supply of said solid fuel at location/s of said first zone below said secondary gas admission means, said means for feeding air adapted to discharge air uniformly, tangentially and in a distributed manner above and throughout said furnace bottom in a directional pattern driving said solid fuel along with recycled solids as a fluidized mixture migrating in a concentric, essentially horizontal, retraceable path following the periphery of said furnace walls below said second zone, displacement means for overflowing said mixture from said first zone into said second zone generating a screwlike trace through said first zone, said means for admission of secondary air adapted to admit gas at multiple points spaced in a horizontal, uniform, geometric pattern, said secondary gas flowing into said second zone in a substantially horizontal plane optionally tipped slightly up or down and in an essentially transverse direction to said path of said fluidized mixture containing said fuel, each of said multiple points tangentially in line with the same relative side of an imaginary horizontal circle at the center of said multiple points and disposed for sustaining said screwlike trace of said mixture from said first zone, said secondary gas having admission velocity sufficient for redirecting said mixture and uniformly distributing said fuel and said air throughout said first and said second zones, means to maintain velocity of the combined gas stream in and above said second zone sufficient for entraining in said combined gas stream a substantial portion of said overflowed recycled solids and solid fuel, means for separation of said substantial solids portion from said combined gas stream downstream of said furance, external means for recycling said separated solids to said second zone as said recycled solids, and means for exhausting said combined gas stream after said solids separation.

2. A steam generator as recited in claim 1 and wherein at least a first portion of said secondary gas comprises air, including a fan or blower for delivering said air to said secondary gas admission means.

3. A steam generator as recited in claim 2 and wherein a second protion of said secondary gas comprises a portion of said combined gas after separation of said solids, including a fan or blower for recirculating said portion of said combined gas to said secondary gas admission means, means to vary the proportions of said air and said recirculated combined gas supplied to said secondary gas admission means.

4. A steam generator as recited in claim 1 and including supplemental up flow tubular platens within said furnace connected in parallel with said first heat abosorption circuits portion on the fluid side, said tubular platens disposed at some distance above said secondary gas admission means sufficient for thorough dispersion of said fuel, gas and recirculated solids mixture throughout said second zone, lanes between said platens and said walls of said furnace, location of said multiple secondary gas admission points and placement of said platens distributing said gas, fuel and recirculated solids mixture uniformly among said lanes.

5. A steam generator as recited in claim 4, said platens straightening the flow of said gas as it leaves the furnace, the surface of said platens disposed in parallel with said combined gas stream.

* * * * *